US010986885B1

(12) United States Patent
Von Behren et al.

(10) Patent No.: US 10,986,885 B1
(45) Date of Patent: Apr. 27, 2021

(54) HAND WARMING POCKET

(71) Applicants: Greg Von Behren, Rockville, MD (US); Heather Von Behren, Rockville, MD (US)

(72) Inventors: Greg Von Behren, Rockville, MD (US); Heather Von Behren, Rockville, MD (US)

( * ) Notice: Subject to any disclaimer, the term of this patent is extended or adjusted under 35 U.S.C. 154(b) by 83 days.

(21) Appl. No.: 16/452,846

(22) Filed: Jun. 26, 2019

(51) Int. Cl.

| | |
|---|---|
| ***A41D 19/00*** | (2006.01) |
| ***A41D 19/015*** | (2006.01) |
| *A41D 31/06* | (2019.01) |
| *A41D 31/10* | (2019.01) |

(52) U.S. Cl.
CPC .... *A41D 19/0041* (2013.01); *A41D 19/01576* (2013.01); *A41D 31/065* (2019.02); *A41D 31/10* (2019.02); *A41D 2200/10* (2013.01); *A41D 2400/10* (2013.01); *A41D 2600/10* (2013.01)

(58) Field of Classification Search
CPC ..... A41D 2200/10; A41D 19/01576
USPC ..... 2/312, 319, 66
See application file for complete search history.

(56) References Cited

U.S. PATENT DOCUMENTS 3,638,284 A * 2/1972 Baker ..... A63B 60/62 24/306
4,351,067 A * 9/1982 Bartels ..... A41D 19/0034 2/160
4,622,961 A * 11/1986 Christensen ..... A61F 5/3738 602/4
4,742,580 A * 5/1988 Phillips, Jr. ..... A41D 19/0041 2/158
4,893,357 A 1/1990 Evans
5,003,637 A * 4/1991 Lonon ..... A41D 19/0024 2/160
5,048,734 A 9/1991 Long
5,139,187 A 8/1992 Fowler
5,269,023 A 12/1993 Ross
5,295,268 A * 3/1994 Pociask ..... A41D 13/081 2/16
5,461,728 A * 10/1995 Staszak ..... A41D 13/081 2/158
5,499,401 A 3/1996 Heinmiller
5,665,057 A * 9/1997 Murphy ..... A61F 5/028 2/311

(Continued)

FOREIGN PATENT DOCUMENTS

CH 708529 A2 * 3/2015 ..... A41F 1/002

*Primary Examiner* — Khoa D Huynh
*Assistant Examiner* — Grace Huang
(74) *Attorney, Agent, or Firm* — Cramer Patent & Design, PLLC; Aaron R. Cramer

(57) ABSTRACT

A hand warming having an open end for receiving a player's hand, a closed end, and a generally cylindrical interior chamber that is located between the open and closed ends. The interior chamber is insulated and surrounded by a water-proof outer covering. A flexible collar having an elastic band closure extends from the perimeter edge of the open end. A looped panel is attached to the outer covering. The panel is attached to the outer covering so as to form first and second tunnels for selectively receiving a belt for vertical mounting. First and second belt loops are attached across the panel for horizontal mounting. A flap that can be closed and the first and second belt loops can be used to retain the hand warmer in place when the hand warmer is horizontally positioned.

14 Claims, 3 Drawing Sheets

(56) References Cited

U.S. PATENT DOCUMENTS 5,934,530 A * 8/1999 Antczak ..... A63B 57/20 224/197
6,076,190 A * 6/2000 Besson ..... A41D 19/01511 2/16
6,438,759 B1 * 8/2002 Jaunault ..... A41D 19/01511 2/16
6,694,575 B1 * 2/2004 Martin ..... A45F 5/02 206/315.3
7,337,474 B1 * 3/2008 Godson ..... A63B 71/146 2/161.2
7,496,969 B2 * 3/2009 Pieczynski ..... A41D 13/0051 2/16
8,602,073 B2 * 12/2013 Swain ..... A45F 3/00 150/106
8,615,814 B1 * 12/2013 Hawkins ..... A41D 13/081 2/66
10,136,685 B2 11/2018 Beck
10,271,596 B2 * 4/2019 Cookus ..... A41D 19/0044
10,750,798 B2 * 8/2020 Goldade ..... A41D 13/081
2004/0172735 A1 * 9/2004 Garland ..... A41D 19/0041 2/160
2006/0086629 A1 * 4/2006 Cacioppo, Jr. ..... A45F 5/06 206/289
2006/0289574 A1 * 12/2006 Cacioppo, Jr. ..... A45F 5/06 224/162
2007/0094766 A1 * 5/2007 Liu ..... A41D 19/0072 2/159
2007/0119013 A1 * 5/2007 Abreu ..... A63B 47/04 15/209.1
2009/0070919 A1 * 3/2009 Kim ..... A41F 9/00 2/319
2009/0178175 A1 * 7/2009 McCrary ..... A45F 5/02 2/161.6
2012/0066810 A1 * 3/2012 Marcus ..... A41D 19/0044 2/16
2015/0101094 A1 * 4/2015 Hinds ..... A41D 13/08 2/16
2018/0125129 A1 * 5/2018 Weitzmann ..... A41D 19/01529
2018/0220724 A1 * 8/2018 Bunn ..... A41D 13/1236
2020/0170319 A1 * 6/2020 Kalliontzis ..... A41D 19/0041

* cited by examiner

HAND WARMING POCKET

RELATED APPLICATIONS

Not applicable

FIELD OF THE INVENTION

The presently disclosed subject matter is directed to baseball and softball aids. More particularly it is directed to hand warming devices for the free hand of a baseball or softball player.

BACKGROUND OF THE INVENTION

Baseball and softball have been and remain very popular sports. The fun, excitement, and pure exhilaration of stepping onto a ballfield with your team is hard to top. Baseball and softball represent unique blends of physical strength, skill, agility, finesse, and hand-eye coordination which cannot be matched in any other sport.

Baseball and softball are seasonable sports in most areas of the country. Usually starting in early spring and continuing through autumn, baseball and softball are often played in cooler weather. While players can and do wear additional garments to keep warm, one place that cannot be covered is a player's throwing hand. Wearing gloves or other coverings on the throwing hand can result in dramatically reduced performance. However, players with cold hands can also have dramatically reduced performance. Problems with cold hands are particularly acute with pitchers and catchers as their hands are in almost constant use.

Accordingly, there exists a need for devices which can keep the throwing hands of baseball and softball players warm without interfering with the use of those hands. Beneficially such devices would be quickly and easily used and would be highly effective. Also, beneficially such devices would be made of readily available materials and could be fabricated using well known processes to produce strong and durable devices. Such devices should allow for freely throwing a ball without impaired throwing speed, accuracy or distance. Ideally, such devices could be worn by players in all positions and should be usable by both left and right-handed players. In practice should devices should allow the use of chemical hand warmers. Preferably such devices would be suitable for being made available at relatively low cost.

SUMMARY OF THE INVENTION

The principles of the present invention provide for devices that help keep the throwing hands of baseball and softball players warm. Such devices can be used without interference with a player's hands. Devices in accord with the present invention can be quickly, easily, and effectively used with little or no training. Such devices are suitable for being made of readily available, weather-proof materials and can be fabricated using well known processes to result in strong and durable devices. Such devices do not detract from throwing speed, accuracy or distance. They are suitable for being worn by players in all positions and can be used by both left and right-handed players. In addition, such devices are suitable for use with chemical hand warmers. Such devices are also suitable for being made available at relatively low cost.

A hand warmer that is in accord with the present invention includes an open end, a closed end, and a generally cylindrical interior chamber that is located between the open and closed ends. The interior chamber is formed using insulation surrounded by an outer covering that is attached to the open end and to the closed end. A flexible collar extends from a perimeter edge of the open end. That flexible collar has a free end. Also included is a looped panel that is attached to the outside of the outer covering. The interior chamber is accessed through the open end.

In practice that hand warmer will have an outer covering made from a waterproof material. The closed end may be planar or cup-shaped, and the insulation may also cover the inner surface of the closed end. For closing the open end, the collar may have an elastic band, and that elastic band may have a diameter that is less than the diameter of the perimeter edge.

A first seam and a second seam can be used to attach the panel to the outer covering so as to respectively form a first tunnel for selectively receiving a belt and a second tunnel for selectively receiving a belt. Beneficially that first and second seams run parallel with one another and with the perimeter edge such that the first tunnel is higher than the second tunnel when a horizontal belt passes through the first tunnel. There may also be a first belt loop that is attached across the panel and a second belt loop that is also attached across the panel such that the first belt loop is located above the second belt loop when the open end is above the closed end. The first belt loop and the second belt loop are configured to receive a horizontal belt when the hand warmer is horizontally supported.

The hand warmer may also include a flap that is attached on one side to the panel. That flap should have a pair of snaps that are aligned with a pair of receivers that are attached to the panel. The pair of snaps and the pair of receivers can hold the flap closed to help retain the hand warmer in position on a belt. In addition, there may be a pull tab attached to the flap to help disengage the snaps and fasteners.

An alternative hand warmer that is in accord with the present invention includes an open end, a closed end, and a generally cylindrical interior chamber that is disposed between the open end and the closed end. That interior chamber is formed from insulation surrounded by an outer covering which is attached to the open end along a perimeter edge and to the closed end. Also included are a flexible collar that extends from the perimeter edge and which has a free end, and a looped panel that is attached to the outer covering by a first seam and by a second seam such that a first tunnel and a second tunnel are formed. The interior chamber is accessed through the flexible collar.

In practice the insulation covers the inside of the closed end and there may be an elastic band at the free end of the collar. When relaxed that elastic band preferably has a diameter that is less than the diameter of the perimeter edge. Beneficially the first and second seams run parallel with one another and with the perimeter edge such that the first tunnel is higher than the second tunnel when a horizontal belt passes through the first tunnel. That hand warmer may also include a first belt loop attached across the panel and a second belt loop that is also attached across the panel. The first belt loop is located above the second belt loop when the open end is above the closed end, and the first and second belt loops are configured to receive a horizontal belt when the hand warmer is horizontally supported.

That alternative hand warmer may also include a flap that is attached to the panel. That flap should include a pair of snaps that align with a pair of receivers that are attached to the panel. The snaps and the receivers can hold the flap closed to help retain the hand warmer in position when on a belt.

Yet another hand warmer that is in accord with the present invention includes an open end, a closed end, and a cylindrical interior chamber located between the open end and the closed end. That interior chamber is formed by internal insulation and by an outer covering which is attached to the open end along a perimeter edge and to the closed end. A flexible collar extends from the perimeter edge and has a free end with an elastic band. A looped panel is attached to the outer covering by a first seam and by a second seam such that a first tunnel and a second tunnel are formed. The interior chamber is accessed through the elastic band.

That alternative hand warmer preferably includes a first belt loop that is attached across the panel and a second belt loop that is attached across the panel. The first belt loop is located above the second belt loop when the open end is above the closed end, and the first and second belt loops are configured to receive a horizontal belt when the hand warmer is horizontally supported.

BRIEF DESCRIPTION OF THE DRAWINGS

The advantages and features of the present invention will become better understood with reference to the following detailed description and claims when taken in conjunction with the accompanying drawings, in which like elements are identified with like symbols, and in which:

DESCRIPTIVE KEY

Figure 1:
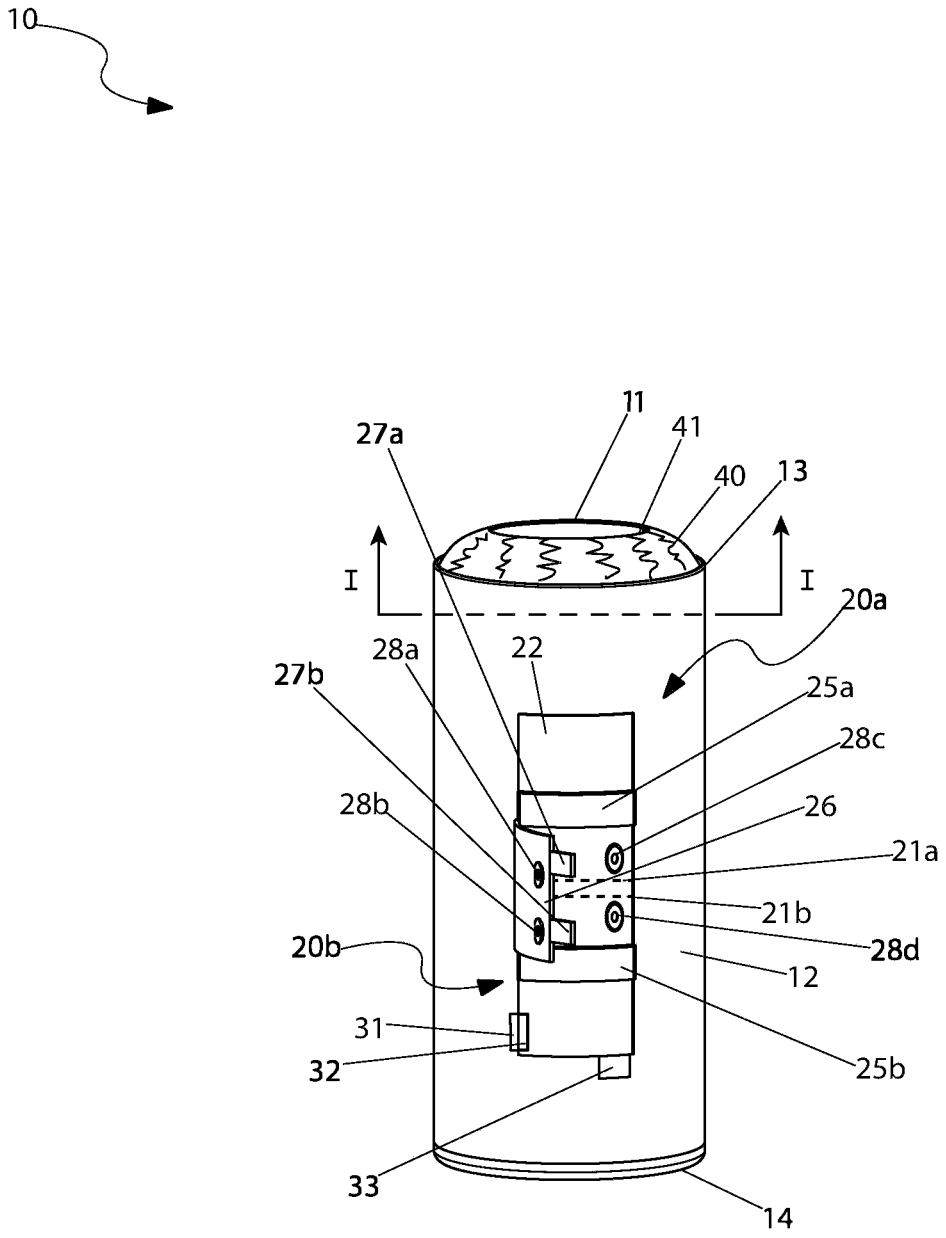
FIG. 1 is a perspective view of a hand warmer 10 that is in accord with a preferred embodiment of the present invention.

10 hand warmer
11 open end
12 outer covering
13 perimeter edge
14 closed end
15 interior chamber
20*a* first tunnel
20*b* second tunnel
21*a* first seam
21*b* second seam
22 panel
25*a* first belt loop
25*b* second belt loop
26 flap
27*a* first pull tab
27*b* second pull tab
28*a* first snap
28*b* second snap
28*c* first receiver
28*d* second receiver
31 first tag
32 second tag
33 third tag
40 collar
41 elastic band
50 insulation
75 belt

DETAILED DESCRIPTION OF THE PREFERRED EMBODIMENT

The present invention is presented in terms of a preferred embodiment hand warmer 10 depicted in FIGS. 1-5*b*. That hand warmer 10 is designed to be supported either horizontally or vertically on a player's belt 75 as respectively illustrated in FIGS. 5*a* and 5*b*. However, the invention is not limited to the specifically described embodiment. A person skilled in the art will appreciate that many other embodiments of the invention are possible without deviating from the basic concept of the invention. Any such work around will also fall under scope of this invention.

The terms "a" and "an" as used herein do not denote a limitation of quantity, but rather denote the presence of at least one (1) of the referenced items.

Figure 4:
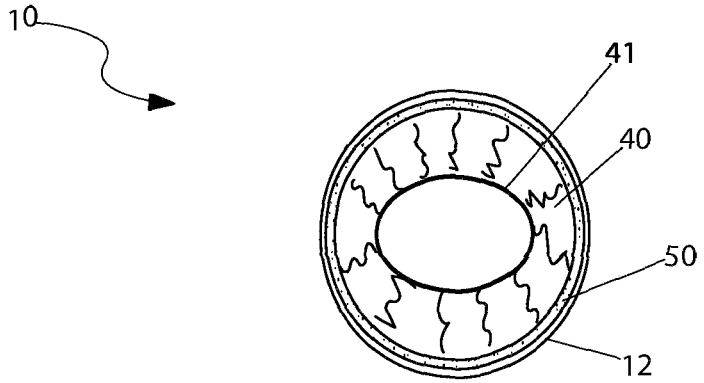
FIG. 4 is a sectional view of the hand warmer 10 taken along line I-I of FIG. 1.

Referring now primarily to FIGS. 1 and 4, the preferred embodiment hand warmer 10 has an overall cylindrical shape with an open end 11, a closed end 14, an outer covering 12, and insulation 50 (FIG. 4). The open end 11 is bounded by one perimeter edge 13 of the outer covering 12. The open end 11 provides access into an interior chamber 15.

Figure 2:
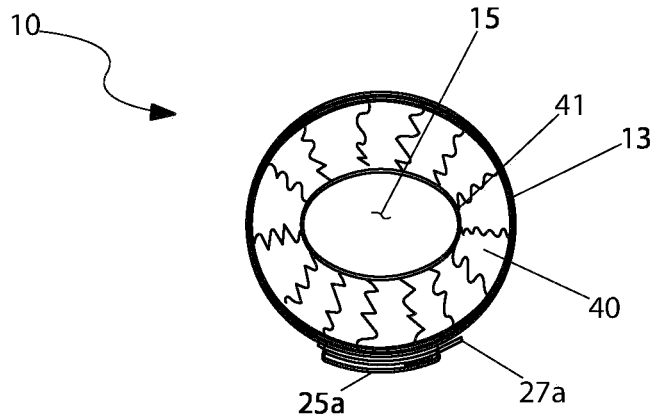
FIG. 2 is a top-down view of the hand warmer 10 illustrated in FIG. 1.

Referring now also to FIG. 2, the outer covering 12 is preferably comprised of a weatherproof and waterproof synthetic material that is capable of being easily cleaned, such as nylon. The closed end 14 is generally planar or cup-shaped and is attached to one end of the outer covering 12. The closed end 14 may be made of the same material as the outer covering 12 but should be thicker and more durable so as to retain heat better. The insulation 50 is affixed to and covers a majority or all of the inner surface of the outer covering 12. Beneficially the insulation 50 also covers the inner surface of the closed end 14. The insulation 50 is envisioned as being batting or a padding that is made from cotton, wool, or a synthetic material. In any event the insulation 50 retards the loss of heat from the interior chamber 15.

Figure 3:
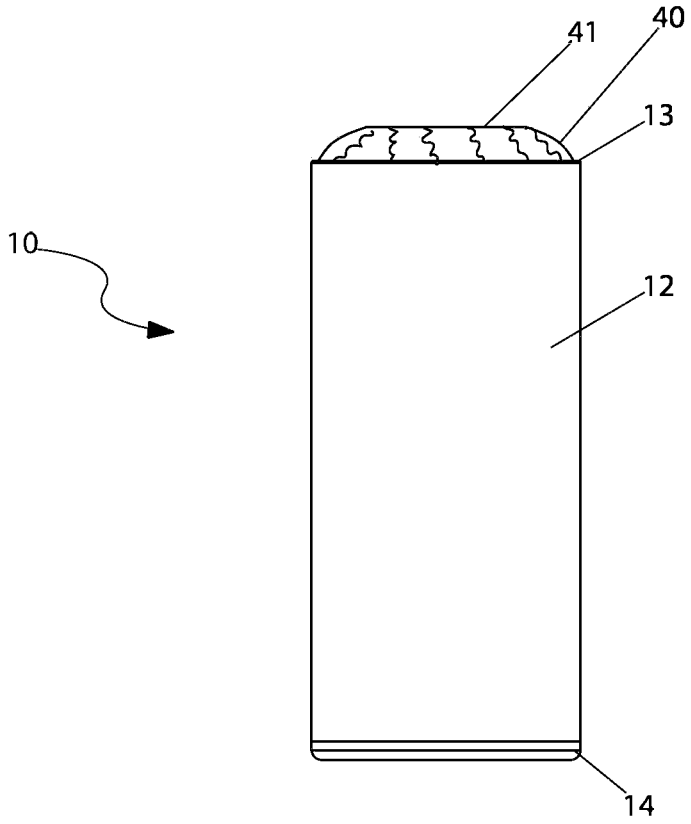
FIG. 3 is an elevational view of the hand warmer 10 illustrated in FIGS. 1 and 2.

Turning now also to FIG. 3, attached to the perimeter edge 13 is a collar 40. At the free end of the collar 40 is an elastic band 41. When relaxed the elastic band 41 has a diameter that is less than the diameter of the perimeter edge 13. The elastic band 41 can stretch to accommodate the passing of a hand into the interior chamber 15 while also creating a relatively snug fit with the arm The collar 40 can bunch up and extend without ripping or tearing. Beneficially the collar 40 is made of the same material as the outer covering 12 and the closed end 14.

As shown in FIG. 1, the hand warmer 10 further includes a looped panel 22 that is attached to the outside of the outer covering 12 (more details are provided below). For balance the panel 22 is centrally located between the perimeter edge 13 and the closed end 14. To provide sufficient rigidity the panel 22 is preferably made stronger and more resilient than the outer covering 12. As shown the panel 22 is rectangular and is attached to the outer covering 12 such that its shorter sides are parallel with the perimeter edge 13. While the foregoing descriptions of the orientation and location of the panel 22 are beneficial it should be appreciated that any orientation and location is acceptable if the panel 22 provides a sufficient support for the hand warmer 10 when attached to a support structure such as a belt 75 (reference FIGS. 5A and 5B).

The panel 22 is preferably attached to the outer covering 12 by a first seam 21*a* and by a second seam 21*b*. The first and second seams 21*a*, 21*b* run parallel with one another and with the perimeter edge 13. The panel 22 and the first seam 21*a* form a first tunnel 20*a* for a belt 75. Similarly, the panel 22 and the second seam 21 *b* form a second tunnel 20*b* for a belt 75. Each tunnel 20*a*, 20*b* is offset from the center of the panel 22. Referencing now also FIG. 5*b*, when the hand warmer 10 is mounted vertically that offset enables the hand warmer 10 to be located higher or lower on the belt 75 to suit the preference of the user 100.

Still referring primarily to FIG. 1, a first belt loop 25*a* is attached across the panel 22 and a second belt loop 25*b* is also attached across the panel 22. The first belt loop 25*a* is located above the second belt loop 25*b* when the hand warmer 10 is orientated vertically with the open end 11 higher than the closed end 12. The first belt loop 25*a* and the second belt loop 25*b* are designed to receive a belt 75 when horizontally supporting the hand warmer 10.

Attached to an edge of the panel 22 between the first belt loop 25*a* and the second belt loop 25*b* is a rectangular flap 26. Opposite the attachment edge the flap 26 has a pair of snaps 28*a*, 28*b*. Respectively located on the panel 22 in alignment with the first and second snaps 28*a*, 28*b* when the flap 26 is closed are a first receiver 28*c* and a second receiver 28*d*. The first and second receivers 28*c*, 28*d* respectively mate with the first and second snaps 28*a*, 28*b* to hold the flap 26 closed when a belt 75 passes through the first and second belt loops 25*a*, 25*b*. A closed flap 26 helps retain the hand warmer 10 in position on a player's belt 75.

To assist opening the flap 26 the flap 26 includes a first pull tab 27*a* and a second pull tab 27*b*. The first and second pull tabs 27*a*, 27*b* are respectively attached to the flap 26 adjacent the first and second fasteners 28*a*, 28*b*. The pull tabs 27*a*, 27*b* extend away from the flap 26 to enable a user 100 to open the flap 26. It is appreciated that more or less pairs of aligned fasteners and receivers fall within the overall scope of the invention.

As shown in FIG. 1, the hand warmer. 10 includes three (3) tags 31, 32, 33 affixed or otherwise bonded to the outer surfaces of the panel 22 and/or the outer cover 30. Each tag 31, 32, 33 provide logo, brand, or material information thereon. The outer covering 12, panel 22, collar 40, and/or closed end 14 can carry the same or similar information.

Figure 5A:
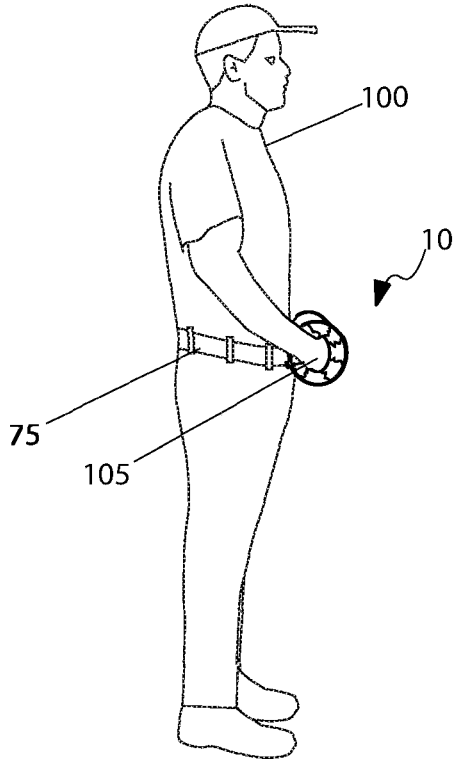
FIG. 5*a* is an environmental view of a user 100 with a hand 105 inserted into the interior chamber 15 of a hand warmer 10 (reference FIGS. 1-4) that is horizontally supported on a belt 75; and, FIG. 5*b* is an environmental view of a user 100 with a hand 105 inserted into the interior chamber 15 of a hand warmer 10 (reference FIGS. 1-4) that is vertically supported on a belt 75.

Referring now to FIG. 5*a*, the hand warmer 10 can be horizontally supported by a belt 75 worn by user 100 by passing that belt 75 through the first and second belt loops 25*a*, 25*b*. The user 100 can then insert their hand 105 into the interior chamber 15. While the insulation 50 helps keep the inserted hand warm if desired a chemical warming packet can be inserted into the hand warmer 10 to provide additional warmth.

Figure 5B:
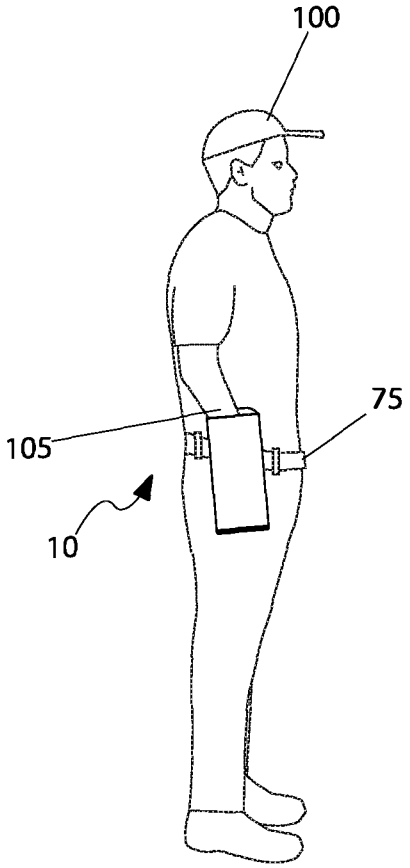

Alternately, and with reference to FIG. 5*b*, the hand warmer 10 may be worn vertically by passing a belt 75 through a selected one of the tunnels 20*a*, 20*b*, depending on the desired vertical height for the open top end 11. Different users 100 will prefer different tunnels 20*a*, 20*b* for comfort. The user 100 can then insert their hand 105 into the interior chamber 15. Again, if desired a chemical warming pack can be inserted into the interior chamber 15.

The foregoing descriptions of a specific embodiment of the present invention have been presented for purposes of illustration and description. They are not intended to be exhaustive or to limit the invention to the precise forms disclosed. Obviously, many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A hand warmer, comprising:

an open end;

a closed end;

a generally cylindrical interior chamber disposed between said open end and said closed end, said interior chamber formed from insulation surrounded by an outer covering which is attached to said open end and to said closed end;

a flexible collar extending from a perimeter edge of said open end, said collar having a free end;

a looped panel attached to the outside of said outer covering;

a first belt loop attached across said panel and a second belt loop attached across said panel;

wherein said first belt loop is located above said second belt loop when said open end is above said closed end;

wherein said first belt loop and said second belt loop are configured to receive a belt when the hand warmer is horizontally supported; and a flap attached on one side to said panel, said flap including a pair of snaps in alignment with a pair of receivers that are attached to said panel, wherein said pair of snaps and said receivers can hold said flap closed to help retain said hand warmer in position when on the belt;

wherein said interior chamber is accessed through said open end.

2. The hand warmer according to claim 1, wherein said outer covering is comprised of a waterproof material.

3. The hand warmer according to claim 1, wherein said closed end is cup shaped.

4. The hand warmer according to claim 1, wherein said insulation further covers an inner surface of said closed end.

5. The hand warmer according to claim 1, further including an elastic band at said free end of said collar.

6. The hand warmer according to claim 5, wherein when relaxed said elastic band has a diameter less than the diameter of said perimeter edge.

7. The hand warmer according to claim 1, further including a first seam attaching said panel to said outer covering and a second seam also attaching said panel to said outer covering, said first and second seams respectively forming a first tunnel for selectively receiving said belt and a second tunnel for selectively receiving said belt.

8. The hand warmer according to claim 7, wherein said first and second seams run parallel with one another and with said perimeter edge such that said first tunnel is higher than said second tunnel when said belt passes through said first tunnel.

9. The hand warmer according to claim 1, further including a pull tab attached to said flap.

10. A hand warmer, comprising:

an open end;

a closed end;

a generally cylindrical interior chamber disposed between said open end and said closed end, said interior chamber formed by insulation surrounded by an outer covering which is attached to said open end along a perimeter edge and to said closed end;

a flexible collar extending from said perimeter edge and having a free end;

a looped panel attached to said outer covering by a first seam and by a second seam such that a first tunnel and a second tunnel are formed;

a first belt loop attached across said panel and a second belt loop attached across said panel;

wherein said first belt loop is located above said second belt loop when said open end is above said closed end; and wherein said first belt loop and said second belt loop are configured to receive a belt when the hand warmer is horizontally supported; and a flap attached on one side to said panel, said flap including a pair of snaps in alignment with a pair of receivers that are attached to said panel, wherein said pair of snaps and said pair of receivers can hold said flap closed to help retain said hand warmer in position on the belt;

wherein said interior chamber is accessed through said flexible collar.

11. The hand warmer according to claim 10, wherein said insulation covers an inside of said closed end.

12. The hand warmer according to claim 11, further including an elastic band at said free end of said collar.

13. The hand warmer according to claim 12, wherein when relaxed said elastic band has a diameter less than the diameter of the perimeter edge.

14. The hand warmer according to claim 10, wherein said first and second seams run parallel with one another and with said perimeter edge such that said first tunnel is higher than said second tunnel when said belt passes through said first tunnel.

* * * * *